US008123636B1

(12) United States Patent
Temprine

(10) Patent No.: US 8,123,636 B1
(45) Date of Patent: Feb. 28, 2012

(54) HUNTING ARROW WITH PHOSPHORESCENT INDICATOR

(76) Inventor: Mark D. Temprine, Salisbury, MD (US)

( * ) Notice: Subject to any disclaimer, the term of this patent is extended or adjusted under 35 U.S.C. 154(b) by 666 days.

(21) Appl. No.: 12/221,318

(22) Filed: Aug. 1, 2008

(51) Int. Cl.
*F42B 6/04* (2006.01)

(52) U.S. Cl. ..... 473/578; 473/586

(58) Field of Classification Search ..... 473/578, 473/585, 586
See application file for complete search history.

(56) References Cited

U.S. PATENT DOCUMENTS

| | | | | |
|---|---|---|---|---|
| 3,875,602 | A | 4/1975 | Miron | |
| 4,106,079 | A | 8/1978 | Drury | |
| 4,207,702 | A | 6/1980 | Boatman et al. | |
| 4,340,930 | A | 7/1982 | Carissimi | |
| 4,537,176 | A * | 8/1985 | Stravitz et al. | 124/62 |
| 4,856,792 | A | 8/1989 | Hardison | |
| 5,562,290 | A | 10/1996 | Wei | |
| 6,364,499 | B1 | 4/2002 | Jones | |
| 7,211,011 | B1 | 5/2007 | Sutherland | |
| 7,331,886 | B2 * | 2/2008 | Morris et al. | 473/578 |
| 7,485,057 | B2 * | 2/2009 | Afshari | 473/586 |

* cited by examiner

*Primary Examiner* — John Ricci
(74) *Attorney, Agent, or Firm* — Montgomery Patent & Design, LLC; Robert C. Montgomery; Joseph T. Yaksich

(57) ABSTRACT

A device and method by which hunting arrows are provided with a plurality of phosphorescent vanes to aid in their location and retrieval, particularly during times of limited visibility is herein disclosed. The plurality of vanes of the arrow are coated with a phosphorescent paint which will self-luminescence at night and give off radiation in the form of visible light. Additionally, the phosphorescent nature of the paint makes finding the arrow easier during the day.

15 Claims, 2 Drawing Sheets

HUNTING ARROW WITH PHOSPHORESCENT INDICATOR

RELATED APPLICATIONS

The present invention was first described in a notarized Official Record of Invention on Aug. 14, 2007, that is on file at the offices of Montgomery Patent and Design, LLC, the entire disclosures of which are incorporated herein by reference.

FIELD OF THE INVENTION

The present invention relates generally to a hunting arrow with an indicator device and, more particularly, to said arrow comprising a plurality of vanes coated with a phosphorescent paint which will self-luminescence in the form of visible light to aid in their location and retrieval, particularly during times of low levels of light.

BACKGROUND OF THE INVENTION

When a bow hunter strikes his game, he is often faced with subsequent tracking of the animal as it can live for several hours after being hit, depending upon the accuracy of the hunter's shot. When this occurs, several things could happen. The game could run so far and so fast that the hunter never catches up to it or the wounded animal could be attacked by other wild animals, ruining the meat. Also, instances have been known to occur where other hunters come upon the wounded game and claim it as their own. The occurrence of these situations is quite frequent when dealing with bow-hunting situations. The difficulty experienced in producing an accurate shot with a bow increases the likelihood that it will not produce an instant kill, thus making necessary the aforementioned tracking. Furthermore, these problems are compounded in the situation where the hunter is hunting at dusk, dawn or in cloudy/foggy situations where visibility is limited. As arrows are becoming increasingly expensive, loss of an arrow can be a very costly proposition. Accordingly, the need has developed for a means by which bow hunters can track their arrows in a quick and accurate manner during night time or diminished light hours. The development of the invention herein fulfills this need.

The present invention is a hunting arrow comprising a cylindrical shaft, an arrow head, a nock, and a plurality of vanes provided with a phosphorescent indicator thereon which provides a means for locating and retrieving the hunting arrow. The phosphorescent indicator comprises a phosphorescent paint that is coated thereon the plurality of vanes, or alternately can be located on the nock, to aid in their location and retrieval during low levels of light. The phosphorescent paint will self-luminescence, thereby making the arrow easier to find during the day as well. As a result, whether tracking stricken game or looking for a lost arrow, the use of the present invention ensures that the hunter can quickly locate it and minimize the risk of loss.

Several attempts have been made in the past to provide arrows that can be found easier. U.S. Pat. No. 4,340,930, issued in the name of Carissimi, describes a light assembly for an archer's arrow comprising a lamp and a battery assembly with a switch. However, unlike the present invention, the Carissimi arrow does not have a phosphorescent indicator located thereon a plurality of vanes and/or a nock of an arrow.

U.S. Pat. No. 4,856,792, issued in the name of Hardison, discloses an archer's arrow having a chemical light source for locating the arrow after flight. However, unlike the present invention, the Hardison arrow uses a chemical light stick that is inserted into a cavity in a transparent plastic arrow nock to help locate the arrow.

U.S. Pat. No. 6,364,499, issued in the name of Jones, discloses an apparatus for illuminating an archer's arrow that provides a nock adapted to receive a bowstring in a drawn position wherein a light source is disposed within the nock. However, unlike the present invention, the Jones arrow comprises a light source that is a chemical light stick only found in the nock.

U.S. Pat. No. 7,211,011, issued in the name of Sutherland, discloses an arrow having a nock with a chemical light source that allows an archer to find and retrieve the arrow easier. However, unlike the present invention, the Sutherland arrow uses a chemical light stick inserted into an end of the arrow as the light source.

None of the prior art particularly describes a hunting arrow with an indicator device comprising a plurality of vanes coated with a phosphorescent paint which will self-luminescence at night and give off radiation in the form of visible light to aid in their location and retrieval that the instant invention possesses. Accordingly, there exists a need for an arrow by which bow hunters can track their arrows in a quick and accurate manner during night time or diminished light hours that operates without the disadvantages as described above.

SUMMARY OF THE INVENTION

In view of the foregoing disadvantages inherent in the prior art, it has been observed that there is need for a hunting arrow with an indicator device comprising a plurality of vanes coated with a phosphorescent paint which will self-luminescence during low levels of light in the form of visible light to aid in their location and retrieval.

To achieve the above objectives, it is an object of the present invention to provide a hunting arrow with indicator device comprising a cylindrical shaft comprising a front end and a rear end opposite the front end, an arrow head located on the front end of the shaft, a nock located on the rear end of the shaft, and a plurality of vanes located around a circumference of the shaft between the nock and the arrow head wherein the device has an phosphorescent indicator thereon which provides a means for locating and retrieving the device.

A further object of the present invention is having the phosphorescent indicator located on the plurality of vanes of the device.

Another object of the present invention is having the phosphorescent indicator comprise a phosphorescent paint that is coated thereon the plurality of vanes of the device.

Yet another object of the present invention is having the phosphorescent paint on the plurality of vanes give an emission of light thereby glowing in an area having low levels of light.

Still yet another object of the present invention is having the phosphorescent indicator located on the nock of the device.

Still yet another object of the present invention is having the phosphorescent indicator comprise a phosphorescent paint that is coated thereon the nock of the device.

Yet still another object of the present invention is having the phosphorescent paint on the nock give an emission of light thereby glowing in an area having low levels of light.

Still another object of the present invention is having the plurality of vanes located around the circumference of the shaft between the nock and the arrow head at a location immediately before the nock at the rear end of the shaft.

Still yet another object of the present invention is having the shaft made of aluminum, carbon fiber reinforced plastic, wood, bamboo, or a similar material.

Yet another object of the present invention is having the arrow head be a bodkin point, a blunt, a judo point, a broadhead, a field tip, a target point, or a similar material.

Still yet another object of the present invention is having the arrow head made of metal or a similar hard material.

Still yet another object of the present invention is having the nock made of wood, plastic, or a similar material.

Yet still another object of the present invention is having an alternate hunting arrow with indicator device comprising a cylindrical shaft comprising a front end and a rear end opposite the front end, an arrow head located on the front end of the shaft, a nock located on the rear end of the shaft comprising a phosphorescent paint coated thereon, and a plurality of vanes located around a circumference of the shaft between the nock and the arrow head comprising the phosphorescent paint coated thereon wherein the phosphorescent paint coated thereon the plurality of vanes and the nock provides a means for locating and retrieving the device.

Yet another object of the present invention is providing a method for using a hunting arrow with indicator device to locate and retrieve the device.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
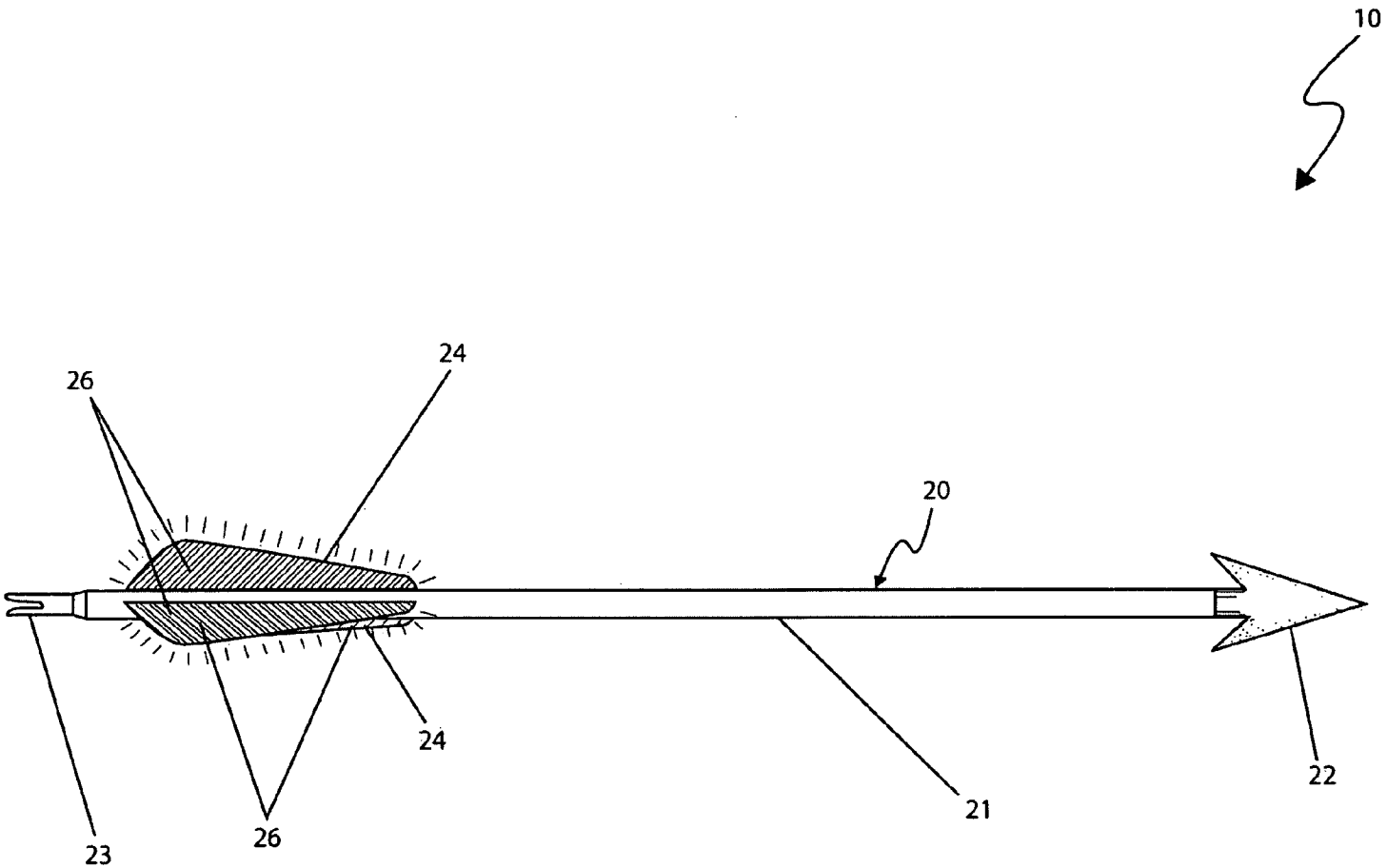
FIG. 1 is a side view of a hunting arrow with phosphorescent indicator 10, according to a preferred embodiment of the present invention; and, FIG. 2 is a side view of a hunting arrow with phosphorescent indicator 10, according to an alternate embodiment of the present invention.

10 hunting arrow with phosphorescent indicator
20 arrow
21 shaft
22 arrow head
23 nock
24 vanes
26 phosphorescent paint

DETAILED DESCRIPTION OF THE PREFERRED EMBODIMENT

Figure 2:
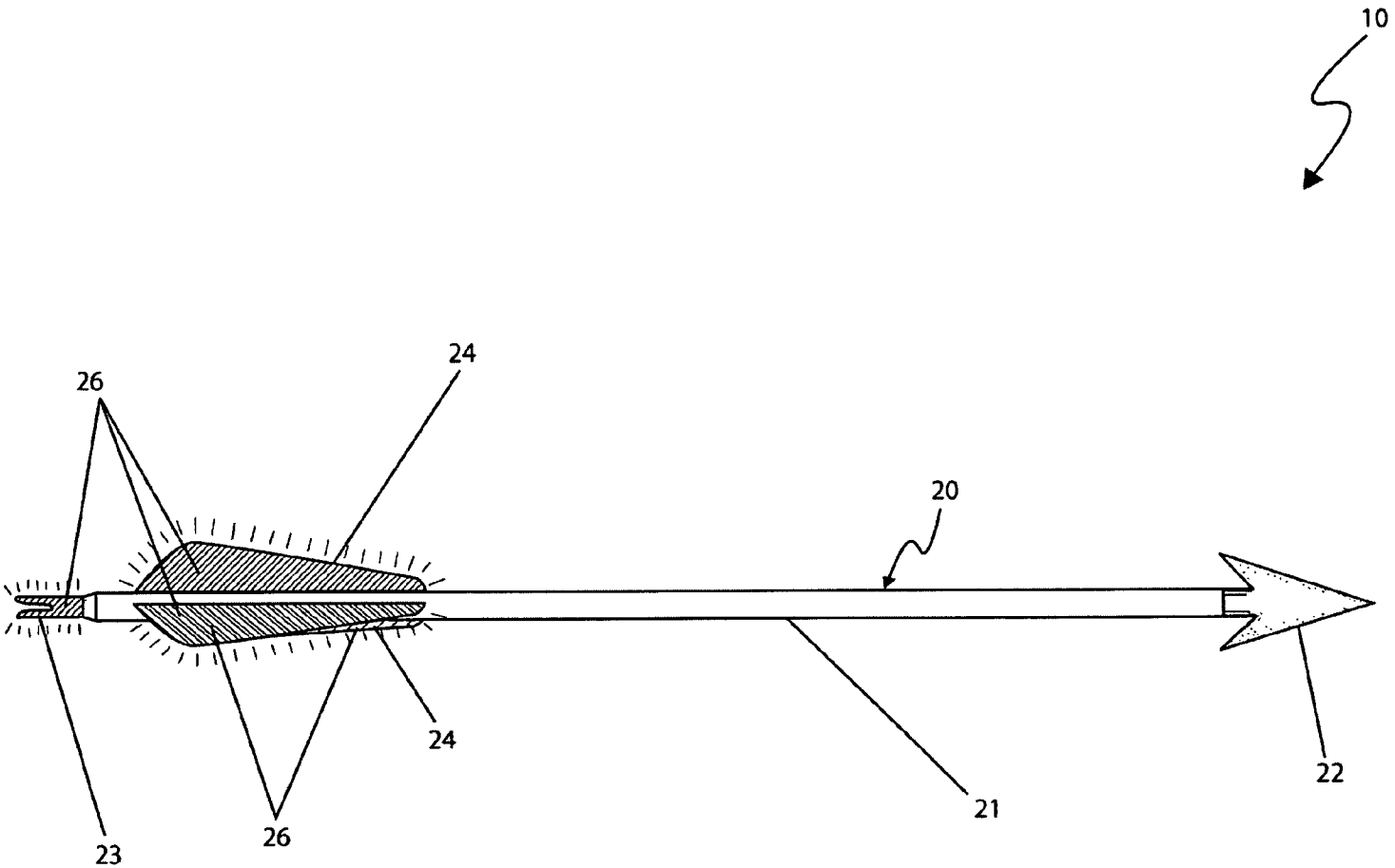

The best mode for carrying out the invention is presented in terms of its preferred embodiment, herein depicted within FIG. 1, and in terms of its alternate embodiment, herein depicted within FIG. 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a hunting arrow with phosphorescent indicator (herein described as the "device") 10, which provides a means for locating and retrieving hunting arrows 20, particularly during times of limited visibility. The vanes 24 of the arrow 20 are coated with a phosphorescent paint 26, which will self-luminescence at night and give off radiation in the form of visible light. Additionally, the phosphorescent nature of the paint makes finding the arrow 20 easier during the day.

The device 10, by means of providing self-luminescence, will make it easier for the hunter to track wounded game thereby preventing needless suffering and minimizing the possibility of another hunter claiming the game, or of an animal attacking the game and ruining the meat. The device 10 also provides a means of quickly locating lost arrows 20 that were shot at targets or game and might be stuck in trees, bushes or lying on the ground. As arrows 20 have become more expensive, this can represent a considerable cost savings. The phosphorescent paint 26 can also be applied if various colors that can be selected based on the environment that the device 10 will be used within.

Referring now to FIG. 1, a side view of the device 10, according to the preferred embodiment of the present invention, is disclosed. The device 10 comprises an arrow 20, a shaft 21, an arrow head 22, a nock 23, and a plurality of vanes 24 coated with a phosphorescent paint 26.

The arrow 20 comprises a conventional arrow with all of the expected features such as a cylindrical shaft 21, an arrow head 22, a nock 23, and a plurality of vanes 24. The shaft 21 is comprised of aluminum, carbon fiber reinforced plastic, wood, bamboo or the like. The arrow head 22 can be any of a variety of conventional types such as, but not limited to: bodkin points, blunts, judo points, broadheads, field tips, target points or the like, and are commonly made of metal or other hard material. The arrow head 22 is located on the front distal end of the shaft 21. The nock 23 is commonly fabricated from wood, plastic, or the like, and is located on the rear distal end of the shaft 21 opposite the arrow head 22. The plurality of vanes 24 are commonly fabricated from materials such as, but not limited to: feathers, plastic or the like. The vanes 24 are located around the circumference on the shaft 21 near the rear distal end just ahead of the nock 23. The phosphorescent paint 26 is a type of paint that gives a persistent emission of light following exposure to and removal of incident radiation thereby glowing in the dark. All of the components of the device 10 are readily available commercial items.

The phosphorescent paint 26 is what makes the device 10 unique. The vanes 24 are envisioned to be coated with the phosphorescent paint 26. The phosphorescent paint 26 will self-luminescence at night and give off radiation in the form of visible light (glow-in-the-dark) thereby providing a means for the hunter to find the arrows 20 in low light or dark conditions.

Referring now to FIG. 2, a side view of the device 10, according to an alternate embodiment of the present invention, is disclosed. The alternate embodiment of the device 10 comprises an arrow 20 similar in nature to the preferred embodiment except that the phosphorescent paint 26 would be applied to the plurality of vanes 24 and to the nock 23.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring the arrows 20; applying the phosphorescent paint 26 thereto the vanes 24 and/or the nock 23, if necessary; exposing the vanes 24 and/or the nock 23 to sunlight or some other light source while hunting or target practicing; shooting the arrows 20 towards the target or game; tracking target or game in the normal fashion; finding the arrows 20 and target or game, particularly during times of limited visibility, by looking for the luminescing phosphorescent paint 26 thereon the plurality of vanes 24 and/or said nock 23.

An alternative embodiment of the present invention 10 comprises an arrow 20 similar in nature to the preferred embodiment except that the phosphorescent paint 26 would be applied to the plurality vanes 24 and to the nock 23. The method of utilizing the alternate embodiment of the device 10 is identical to that of the preferred embodiment, with the enhancement of the additional luminescence of the phosphorescent paint 26 thereon the nock 23 of the arrow 20.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An arrow with an indicator device, comprising:
- a cylindrical shaft comprising a front end and a rear end opposite said front end;
- an arrow head located on said front end of said shaft;
- a nock located on said rear end of said shaft; and,
- a plurality of vanes located around a circumference of said shaft between said nock and said arrow head;
- wherein said device has a phosphorescent indicator thereon which provides a means for locating and retrieving said device;
- wherein said phosphorescent indicator is located on said plurality of vanes and said nock such that said phosphorescent indicator is spaced from said shaft;
- wherein said phosphorescent indicator is a phosphorescent paint; and,
- wherein said shaft has a continuous and unitary body.

2. The device of claim 1, wherein said plurality of vanes are located around said circumference of said shaft between said nock and said arrow head at a location immediately before said nock at said rear end of said shaft.

3. The device of claim 1, wherein said shaft is made of one of the following list consisting of: aluminum, carbon fiber reinforced plastic, wood, and bamboo.

4. The device of claim 1, wherein said arrow head is made of one of the following list consisting of: a bodkin point, a blunt, a judo point, a broadhead, a field tip, and a target point.

5. The device of claim 1, wherein said arrow head is made of metal.

6. The device of claim 1, wherein said nock is made of wood or plastic.

7. An arrow with an indicator device, comprising:
- a cylindrical shaft comprising a front end and a rear end opposite said front end;
- an arrow head located on said front end of said shaft;
- a nock located on said rear end of said shaft comprising a phosphorescent indicator thereon; and,
- a plurality of vanes located around a circumference of said shaft between said nock and said arrow head comprising said phosphorescent indicator thereon;
- wherein said phosphorescent indicator thereon said plurality of vanes and said nock provides a means for locating and retrieving said device.

8. The device of claim 7, wherein said phosphorescent indicator located on said plurality of vanes is a phosphorescent paint coated thereon.

9. The device of claim 7, wherein said phosphorescent indicator located on said nock is a phosphorescent paint coated thereon.

10. The device of claim 7, wherein said plurality of vanes are located around said circumference of said shaft between said nock and said arrow head at a location immediately before said nock at said rear end of said shaft.

11. The device of claim 7, wherein said shaft is made of one of the following list consisting of: aluminum, carbon fiber reinforced plastic, wood, and bamboo.

12. The device of claim 7, wherein said arrow head is one of the following list consisting of: a bodkin point, a blunt, a judo point, a broadhead, a field tip, and a target point.

13. The device of claim 7, wherein said arrow head is made of metal.

14. The device of claim 7, wherein said nock is made of wood or plastic.

15. A method for using a hunting arrow with indicator device, said method comprising the steps of:
- providing said device, comprising:
  - a cylindrical shaft comprising a front end and a rear end opposite said front end;
  - an arrow head located on said front end of said shaft;
  - a nock located on said rear end of said shaft comprising a phosphorescent paint coated thereon; and,
  - a plurality of vanes located around a circumference of said shaft between said nock and said arrow head comprising said phosphorescent paint coated thereon;
  - wherein said phosphorescent paint coated thereon said plurality of vanes and said nock provides a means for locating and retrieving said device;
- acquiring said hunting arrows;
- applying said phosphorescent paint thereto said plurality of vanes and said nock, if necessary;
- exposing said plurality of vanes to sunlight or some other light source while hunting or target practicing;
- shooting said hunting arrows towards the target or game;
- tracking target or game in a normal fashion; and,
- finding said hunting arrows and target or game, particularly during times of limited visibility, by looking for said luminescing phosphorescent paint thereon said plurality of vanes and said nock.

* * * * *